United States Patent [19]

Hicks

[11] Patent Number: 4,995,219

[45] Date of Patent: Feb. 26, 1991

[54] COMBINATION CUTTER AND BAGGER FOR PHOTOGRAPHIC NEGATIVES

[76] Inventor: Ray T. Hicks, 2605 Corunna Rd., Flint, Mich. 48503-3362

[21] Appl. No.: 450,203

[22] Filed: Dec. 13, 1989

[51] Int. Cl.[5] ..... B65B 63/00; B65B 5/08; B65B 35/28; B65B 43/30

[52] U.S. Cl. ..... 53/411; 53/435; 53/457; 53/459; 53/520; 53/564; 53/570; 53/574; 53/266 A; 53/236; 53/131; 53/386; 83/100; 83/248; 83/560

[58] Field of Search ..... 53/520, 435, 460, 459, 53/386, 569, 570, 411, 131, 389, 457, 564, 574, 248, 251, 236, 266 A; 83/100, 240, 248, 560, 948

[56] References Cited

U.S. PATENT DOCUMENTS

| | | | |
|---|---|---|---|
| Re. 28,350 | 3/1975 | Lerner | 53/386 X |
| Re. 32,328 | 1/1987 | Russell | 53/386 X |
| 2,932,142 | 4/1960 | Sindzinski | 53/386 |
| 3,355,166 | 11/1967 | Plumb | 53/389 X |
| 4,055,932 | 11/1977 | Wanner | 53/386 X |
| 4,139,978 | 2/1979 | Jensen et al. | 53/520 X |
| 4,154,046 | 5/1979 | Weber et al. | 53/520 X |
| 4,174,599 | 11/1979 | Callet et al. | 53/386 X |
| 4,217,743 | 8/1980 | Escales et al. | 53/131 X |
| 4,373,319 | 2/1983 | Pullen et al. | 53/386 X |
| 4,696,210 | 9/1987 | Cain et al. | 53/560 X |
| 4,787,766 | 11/1988 | Lörsch | 53/520 X |

*Primary Examiner*—Horace M. Culver
*Attorney, Agent, or Firm*—Krass & Young

[57] ABSTRACT

The present invention relates to a device for cutting photographic film into individual negatives and placing the cut negatives into envelopes. The invention utilizes a permeable conveyor and vacuum fan arrangement to transport the negatives after they are severed by the cutting mechanism. A pair of opposed fan assemblies located on either side of continuous feed envelopes serve to open an individual envelope. The opened envelope is located in close proximity to the conveyor. In this configuration, an individual negative, retained by suction against the permeable conveyor, can be delivered to the opened envelope extending off the edge of the conveyor track and entering the open envelope. A burst of air may be used to ensure the individual negative's placement into the envelope. A computer coordinates and controls various functions of operations, including transportation movement of the negative and envelopes and printing.

18 Claims, 4 Drawing Sheets

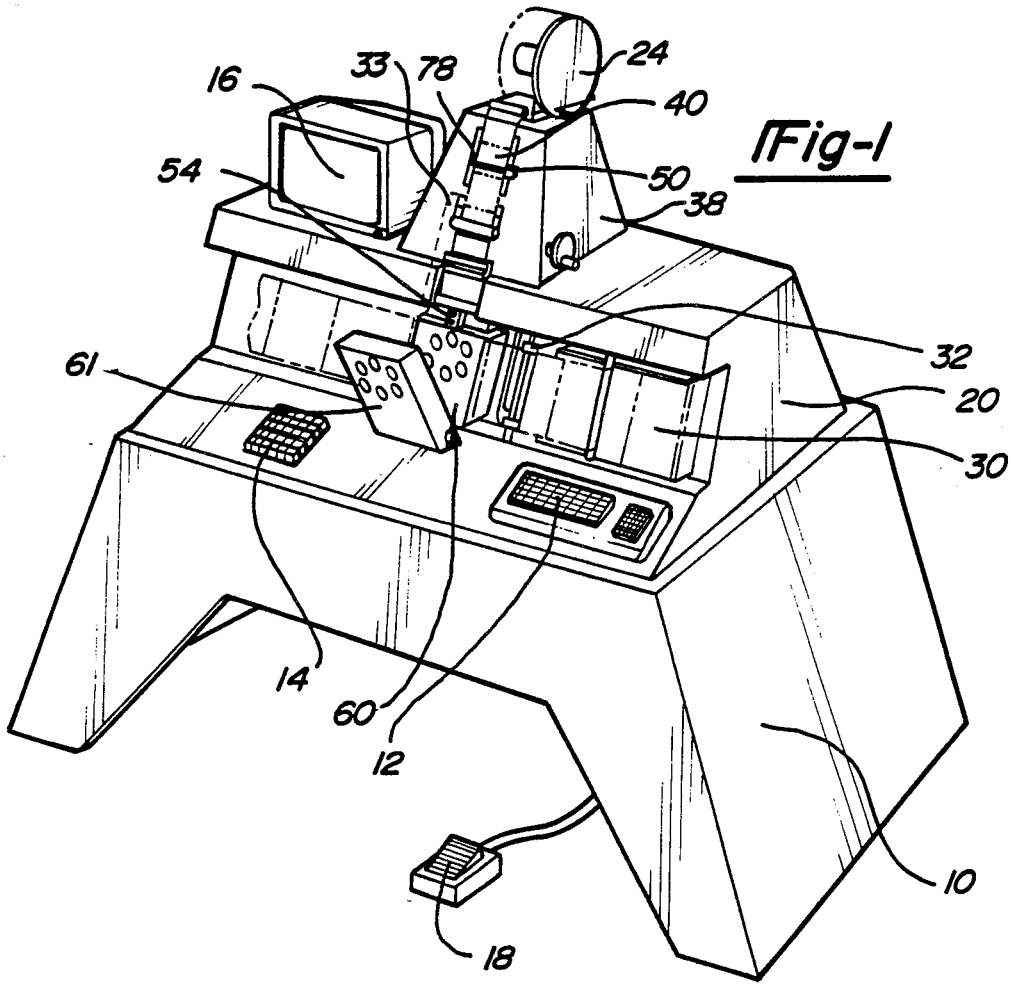
Fig-1
Fig-3
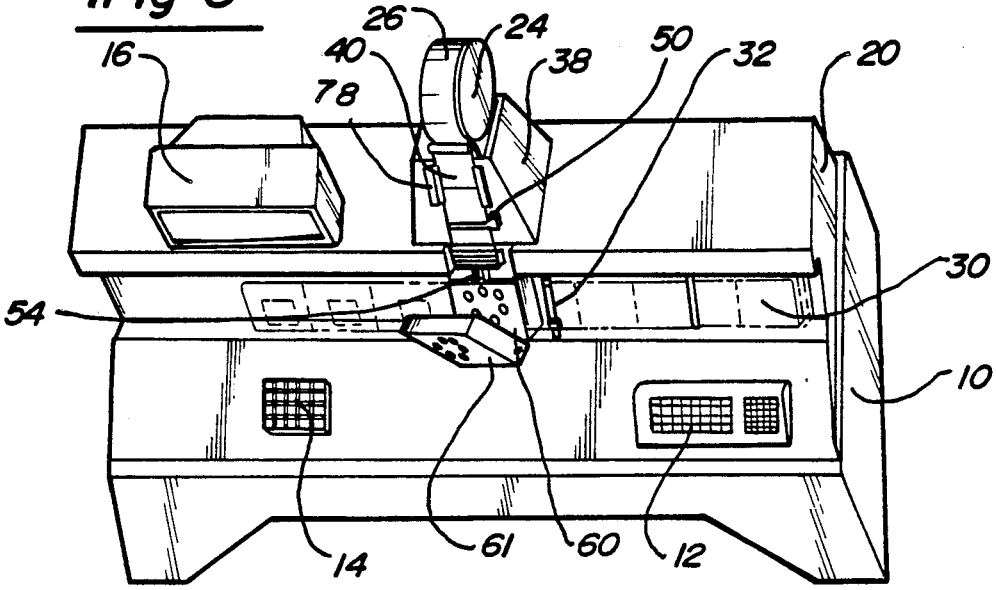

COMBINATION CUTTER AND BAGGER FOR PHOTOGRAPHIC NEGATIVES

FIELD OF THE INVENTION

The invention pertains to devices for cutting photographic negatives from a continuous strip, and placing selected negatives in bags for storage and shipment.

BACKGROUND OF THE INVENTION

Commercial processing of photographic film has become a well established industry. Commercial photographers produce large numbers of photographic exposures, and correspondingly large numbers of photographic negatives, even though the actual sale of photographs may constitute photographic prints of ten percent or less of the actual number of photographic exposures taken by the photographer. To avoid the expense incumbent in printing many exposures which will not ultimately be sold to the customer, the commercial photographic processing industry routinely deals with the developed negatives only as the method of evaluating the quality of the photographs. Sample prints or "contact sheets" are often produced for the commercial photographer's editing purposes.

In any photographic operation, it is important to maintain the developed negative in the event that reprints or edited reprints of a photograph are necessary. Photographic negatives, while necessary for these purposes, and useful in a variety of ways in the commercial photographic environment, are difficult to store and handle. Because they are relatively soft, they are subject to damage through mishandling. Because they are a negative image, they are difficult to correlate with real-life images. Finally, because they are small, lightweight and of low mass, they are easy to misplace, difficult to store, and difficult to manipulate in an automated environment.

Commercial photographic studios require accurate separation of photographic negatives from large rolls of developed film, transfer of photographic negatives to suitable storage media, and classification of the negatives in relation to the storage media to facilitate their storage and recovery. Photographic negatives also need to be protected from damage due to mishandling. Typically, these requirements have been met by storing the photographic negatives in separate envelopes designed specifically for that purpose. However, placement of individual photographic negatives in envelopes by hand is a tedious process, and subjects the photographic negatives to damage from mishandling. Accordingly, a number of methods have been employed for the automated cutting of photographic negatives from a long roll of such negatives, and for the placement of such negatives in storage envelopes.

Previous methods for separation and storage of photographic negatives include the use of a continuous supply of storage envelopes. The storage envelopes are presented to a device for cutting the negatives from a continuous roll and for automatically inserting the negatives into appropriate envelopes. Typically, the continuous supply of storage envelopes is configured for tractor feeding, with perforations allowing the individual envelopes to be separated from one another once the negatives have been cut and placed in the envelopes. This type of continuous supply of storage envelopes may be manufactured from a variety of materials, including paper, acetate, and paper-acetate combinations.

The tractor feed strips are perforated for removal after use during insertion of the negatives.

Previous methods for accomplishing the abovedescribed task required a "leader" and "trailer" section on a continuous supply of storage envelopes. It was also necessary to thread the leader section through the entire portion of the mechanism of the negative bagger. This process results in a waste of a substantial number of storage envelopes.

Directing the cut negative into the envelopes has remained an imprecise procedure. Typically, the apparatus relied upon the force of gravity to direct a cut negative into an envelope located beneath the negative cutter. Because negatives have high surface area and low mass, they are easily affected by drafts and currents of air when allowed to drop freely; frequently causing the negatives to miss the opening in the envelope, and to become lost or damaged as a result. Occasionally, the negative would fill only partially into the envelope, requiring the operator to manually insert the negative further into the envelope to insure desired movement through the tractor feed mechanism.

To insure a clear opening in the envelope for the negative, existing machines use a blower located above the envelope. This blower directs air down toward the top of the envelope, thereby forcing it open. However, this method operates unreliably. The blower often blows both sides of the envelope in the same direction, thereby allowing the cut negative to fall outside the envelope. Other methods comprise mechanical arms with vacuum fittings which mechanically move to open the envelope. While this method is functional, the time required for the vacuum arm to lower into position, activate a vacuum source, raise to open the envelope, and deactivate the vacuum source involves substantial machine cycle time, significantly slowing the insertion operation. Further, the vacuum arm is very sensitive to variation in vacuum pressure. An excessive vacuum causes the bag to deform, inhibiting the entry of the negative; insufficient vacuum results in an ineffective grip on the envelope. Further, the vacuum is often sufficient to exert a vacuum through both layers of a coarse envelope material, causing both sides of the envelope to adhere to the vacuum.

The present invention is designed to overcome each of the above-referenced limitations, as will be seen in the detailed description of the drawings and invention which follow.

SUMMARY OF THE INVENTION

The present invention employs a computer to coordinate and control the actions of a machine designed to cut and store photographic film negatives. Suitable controls facilitate the integration of operator commands with computer automation.

Large rolls of photographic film are supported in a holder designed to feed the photographic film along a conveyor system to a cutter blade assembly. Alternatively, shorter sections of photographic film can be fed onto the conveyor system bypassing the holder. The film is transported along the conveyor system beneath a cutter blade. The motion of the film along the conveyor system is controlled by an operator, who establishes the amount of travel between cuts to correspond to the particular dimensions of the film processed. The operator manually indexes the travel with a cursor or pointer monitored by the computer.

A hydraulically or electronically actuated cutter blade sequentially cuts the film. The individual cut negatives adhere to the conveyor system by virtue of a vacuum source under the conveyor.

A series of continuous feed storage envelopes are disposed on a track beneath the cutter blade and film conveyor system. The envelopes are disposed so that, when opened, they are oriented to receive the individual cut negatives.

Fan assemblies are disposed on opposite sides of the envelope track. These fan assemblies have relatively large intake openings corresponding in site to the size of the envelope to be opened. The first fan assembly creates a vacuum on the back side of the envelope to secure the envelope. The second fan assembly creates a similar vacuum on the front side of the envelope, pulling the front side and thereby opening the envelope.

The negative conveyor system transports the cut negative toward the envelope. The conveyor momentum propels the negative from the end of the conveyor to the open envelope. A burst of air additionally drives the negative fully into the open envelope as the negative leaves the conveyor. The envelopes are advanced and, as the negative and envelope leave the respective fan assemblies, the envelope returns to its closed configuration.

A printer, disposed proximate the track of the continuous feed storage envelopes, allows for information about individual negatives to be printed directly on the corresponding envelope. The operator enters data into the computer via a keyboard for printing identification information. Thus, the individual negatives may be identified while they are being cut and bagged.

DESCRIPTION OF THE DRAWINGS

These and other objects and aspects of the present invention will become clear from the following detailed description of the invention in which:

FIG. 1 is a perspective view of the invention;

FIG. 3 is an overhead view of the invention; and

DESCRIPTION OF THE PREFERRED EMBODIMENT

Figure 2:
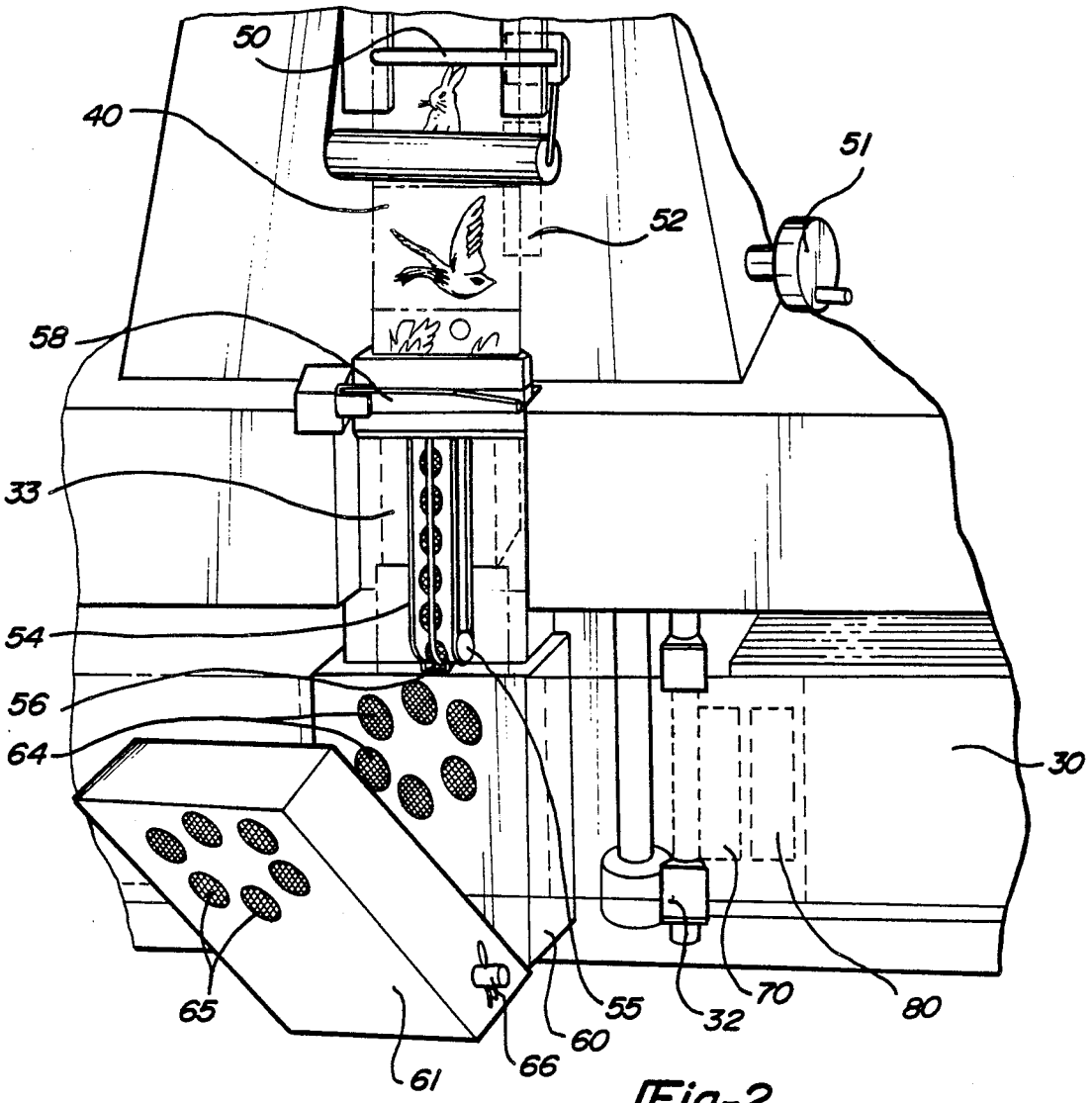
FIG. 2 is a close-up perspective view of the conveyor and envelope assemblies.

The preferred embodiment of the present invention occupies a combined operator console and housing. In this configuration, an operator seated at the console has access to all control devices as well as the photographic film and the continuous feed storage envelopes.

With reference to FIGS. 1 and 3, the invention occupies a desk shaped housing structure. A lower console 10 supports the overall structure and positions all control devices for convenient operator use. Keyboard 12 provides the primary access to operation of the invention. Cursor pad 14 provides control over the positioning of the photographic film 40 in relation to cursor 50. Foot switch 18 provides control of advancement for operation of the cutting and bagging process. The functioning of the relative controls and operations will be disclosed in detail hereinafter.

An upper console 20 extends from the top surface of the lower console 10. The continuous feed storage envelopes 30 removably and transportably mount on transport track 32 in a relatively vertical plane on the front face of the upper console 20. Further supported on the front face proximate said transport track 32 are a pair of fan boxes 60 and 61. Fan box 60 rigidly mounts within the upper console 20 while fan box 61 pivotally mounts in front of fan box 60. Fan box 60 and fan box 61 are further mounted to allow the transport track 32 to deliver the first and all subsequent continuous feed storage envelopes between fan box 60 and fan box 61. This short transport track 32 for envelopes 30 eliminates the need to have leader and trailer pieces and allows the first and last envelopes to be loaded. The operation of this arrangement will be disclosed in detail hereinafter.

A CRT 16 displays information on machine operation parameters and accepts input for production operations. The machine operator utilizes CRT 16 in controlling machine operations but it is not essential for operation.

Support tower 38 mounts on top of the upper console 20. Photographic film holder 24 for film reels 26 dispenses photographic film 40 onto conveyor 54 utilizing guides 78. The support tower 38 mounts proximate the fan box assemblies 60 and 61 and continuous feed storage envelopes 30. Thus, photographic film 40 can be cut into the individual negatives which are located for placement into continuous feed storage envelopes 30.

The operation of the present invention occurs in essentially two main steps. First, the invention cuts an individual section of photographic film 40, typically corresponding to a single negative exposure. Then the invention deposits the cut section into a specific envelope 30.

The present invention utilizes a number of drive mechanisms. All such drives are preferably step motors under computer control. The computer operator programs all aspects of transport of film 40 and envelopes 30, including acceleration and deceleration, to optimize the transport rates and machine cycle time.

More specifically, with reference to FIG. 2 and FIG. 3, the photographic film 40 is aligned on conveyor 54 between guide rails 78. Photographic film 40 adheres to conveyor 54 by virtue of suction directed beneath conveyor 54. To facilitate the suction, conveyor 54 is constructed to transmit air easily. This can be accomplished utilizing a porous or open weave material or parallel spaced-apart neoprene O-rings or bands (as shown in FIG. 2). A single or multiple fan assembly 33 mounts below conveyor 54 having an intake proximate the conveyor 54. By directing air away from conveyor 54 the vacuum thus created secures the photographic film to the conveyor 54 surface through suction alone. Thus, the photographic film 40, (whether cut or uncut) adheres to conveyor 54. Fan assembly 33 insures reliable transportation of the cut negatives.

Photographic film 40 is advanced along by computer controlled step motors. Rollers, such as roller 55, serve to maintain the physical integrity of conveyor 54. Roller 55 drives conveyor 54 by suitable and conventional connection, through belts or gears, from a stepper motor. Tension in conveyor 54 facilitates rotation thereof. Cursor 50 is manually positioned to identify the amount of travel of the conveyor between cuts. Hand wheel 51, connected to control cursor 50 travel, positions the cursor 50. Hand wheel 51 is also connected to a shaft encoder, and transmits the established amount and direction of cursor 50 movement and further relates the position of cut indication cursor 50 for the operator with control information for the computer. The distance between shear knife 58 and cursor 50 is thus monitored to establish the amount of travel for film 40 advance.

Shear knife 58, conventionally driven either electrically or hydraulically, slices photographic film 40 at the predetermined location, set by cursor 50. However, the shear knife 58 remains open on one end to allow easy threading of film through the mechanism. After cutting an individual negative, conveyor 54 controls the movement and placement of the cut negative.

Figure 2A:
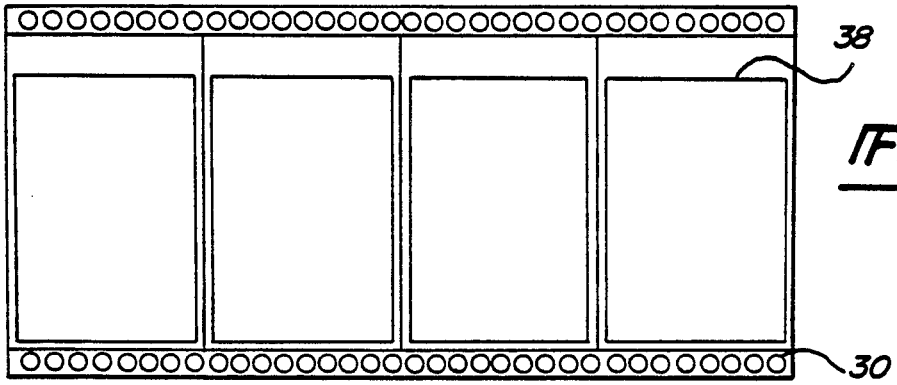
FIG. 2A is a front view of the continuous feed envelopes.

With reference also to FIG. 2A, the continuous feed envelopes 30 align on transport tracks 32 so that envelope opening 38 on each envelope 30 faces upward on the forward face. Transport tracks 32, controlled by the computer and operator, rotate using stepper motors to position an individual envelope 30 below conveyor 54 and between fan box 60 and fan box 61.

To open the selected and positioned envelope 30, fan box 60 operates to secure the rear face of the envelope 30. In operation, an internal fan causes a flow of air away from the envelope 30 creating a vacuum on the rear face. The internal fan takes in air from a plurality of large intake openings 64 on the face of fan box 60 which abuts the selected envelope 30. Output openings are positioned on the rear face of fan box 60. When an envelope 30 is positioned in front of fan box 60 and the internal fan operates, the rear face of the envelope 30 adheres to the large intake openings 64. This secures the envelope for loading a negative therein.

Fan box 61 operates in similar fashion to lift the forward face of envelope 30, so that envelope opening 38 reaches an optimum open attitude. Fan box 61 rotates about pivot 66 to facilitate loading and provide a stationary operative mode. When rotated forward (as shown), the fan box 61 attains a loading position which allows the continuous feed supply envelopes to be easily loaded through an unobstructed path. The loading position provides simplified loading of envelopes 30 on transport track 32, eliminating bridges and tunnels around transport track 32. After loading the envelopes 30 in place, the fan box 61 is rotated to a stationary operating position in closer proximity to fan box 60. Fan box 61 also houses an internal fan which forces the flow of air from large intake openings on the face proximate fan box 60 and out through output openings 65. This flow of air away from the front face of envelope 30 creates a vacuum which pulls the front face of envelope 30 open.

Figure 2B:
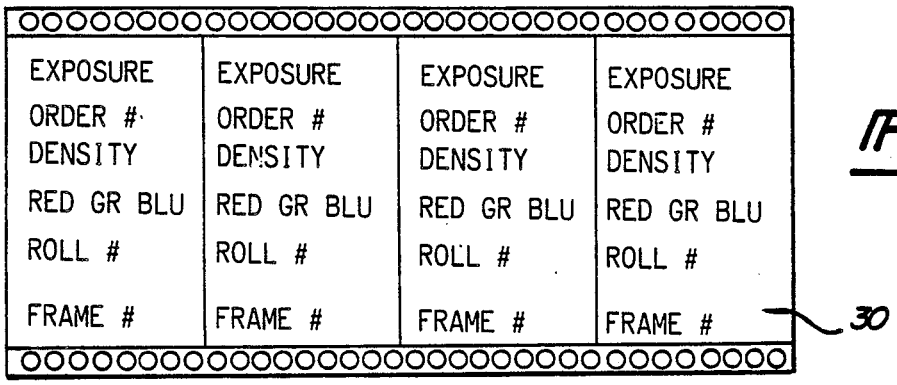
FIG. 2B is a rear view of said envelopes.
Figure 2C:
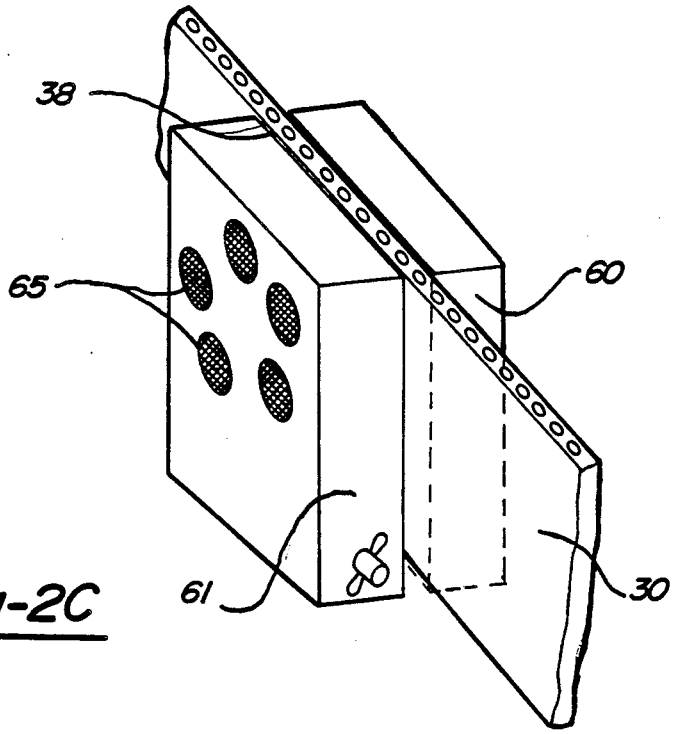
FIG. 2C is a perspective view of the envelope assembly having an open envelope.

With reference also to FIG. 2C, the envelope 30 opens by the combined effect of fan box 60 and fan box 61. Fan box 60 holds envelope 30 in place, while fan box 61 lifts open the front face. With the arrangement, a variety of envelope materials may easily be opened. The gap between fan box 60 and fan box 61 determines the opening width of envelope 30, which remains constant. Since the fan box 60 and fan box 61 remain operably stationary and operate continuously, as each envelope 30 enters the gap between said fan boxes, each envelope opens. Operation speed dramatically increases due to this elimination of moving parts during the operational sequence and the automatic opening of envelopes 30.

The automatic opening of envelope 30 further allows the use of a pusher-type tractor feed track 32, because such opening effectively stiffens the continuous feed envelopes 30. A very short tractor track may be utilized, since envelope 30 stiffens during operation and does not require extensive external stiffeners.

To insert a cut negative into an individual envelope 30, conveyor 54 rotates about rollers 55. Rotation of conveyor 54 moves the cut negative, and as the cut negative approaches the end of conveyor 54, continued rotation causes the cut negative to extend from the end of conveyor 54 and enter the envelope 30. As the cut negative leaves conveyor 54, a short burst of pressurized air from nozzle 56 drives the negative into envelope 30. By positioning this burst of air behind the negative, the cut negative is driven to the bottom of envelope 30 after it has entered the envelope 30 for secure enclosure. The computer controls the air bursts from a conventional pressure source, such a compressed air tank.

Control of the invention is coordinated by a computer having two dedicated circuits. These dedicated cards are conventionally known in the industry.

Figure 4:
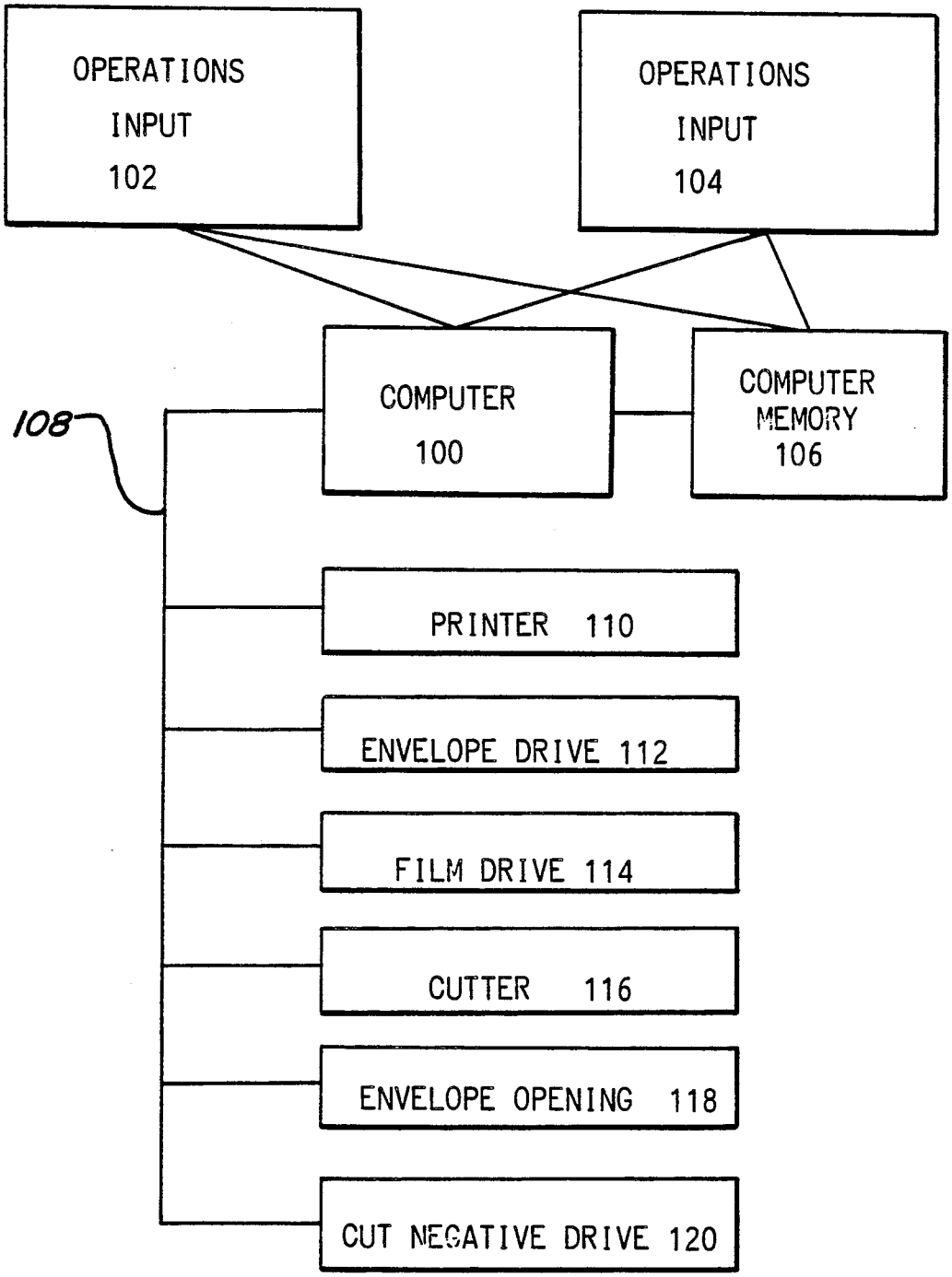
FIG. 4 is a system flow chart.

With reference to FIG. 4, the computer 100 can be preprogrammed to receive operations input 102 from its associated components or operator input 104 from the operator manually. The computer 100 can receive these inputs directly or the inputs can be stored in computer memory 106 for delayed use. Thereafter, the computer 100 can send appropriate equipment operations instructions to the various pieces of processing equipment over a computer network 108, using commercially available technology. The computer 100 can be programmed to automatically coordinate the operations of all aspects of the present invention or individually operate a single function, such as printer 110, envelope drive 112, film drive 114, cutter 116, envelope opening 118, or cut negative drive 120.

An input card connects the output of individual sensors, collectively grouped as operations input 102, to the computer 100 and coordinates the control of actuators and drives accordingly.

For example, in FIG. 2, sensor 52 is positioned to scan digital code located on the side of film 40. This digital code relates to information about a specific photograph and may include order, photographer, exposure, print size or other related information. The code being read by sensor 52 may then be utilized in automatically printing the codes expanded information on the envelope 30 which will hold the specific negative. The code can also be utilized to automatically group multiple specific negatives into a single envelope 30. Other sensors can similarly be positioned to scan all other operations aspects such as conveyor 54 travel and envelope 30 travel. The input card serves to connect these sensors to the computer 100.

The computer program monitors and determines the present status of the machine and controls external actuators to cause operation of the machine in appropriate sequence and interval programmed by the operator. All timing parameters and rates of travel for operations can be set by the operator. A maintenance mode can load and test the machine without electric test gear.

With reference to FIGS. 2 and 2B, printer 80, controlled by both the computer and operator, allows identification information, entered by the operator to be printed on an envelope 30. Illuminator 70 aids the operator in identifying the envelope 30 and information printed thereon. Information about the negative to be inserted, photographic printing data or order information can be printed from either the digital code or operator input. (FIG. 2B shows an example of the type of information typically printed on the rear face of envelopes 30.) Further, the envelopes can be sequentially numbered by the printer to further identify the negatives.

After loading the film 40 and envelopes 30, the operator adjusts the film 40 using the cursor pad 14 for the first cut and the cursor 50 using the hand wheel 51 for subsequent cuts.

An operator typically controls a complete cycle of operations. The individual negative cut from film 40 remains retained on conveyor 54. The envelope 30, held open in position between fan box 60 and fan box 61, receives the negative from conveyor 54, aided by the pressurized air from nozzle 56. The envelop 30 is then advanced one position, while film 40 advances one position as determined by cursor 60. The cycle having complete, the machine remains ready for initiation of another cycle.

Several situations may arise which require deviation from the complete cycle as described. A common deviation occurs when multiple individual negatives are placed in a single envelope. In that situation, a cut negative advances into the envelope 30 and the film 40 advances for the next cut. The envelope 30, however, does not advance, and remains in place for additional negatives.

A second situation requiring deviation arises when an operator must physically handle an individual negative. The negative can be cut and retained on the conveyor 54. The film advances, and the negative can be removed manually form the conveyor 54.

Each operation can be controlled individually by the computer operator, in subgroups of operations, or the complete cycle can be utilized as programmed.

As disclosed, many alternative embodiments may be utilized without departing from the present invention as disclosed herein.

I therefore claim:

1. A device for cutting photographic film into individual negatives and placing said individual negatives into individual continuous feed storage envelopes, each said envelope having a first face base side and a second face opening side, said device having cutting means for severing said photographic film into individual negatives, means for transferring said negatives to said envelopes and means for opening said envelopes for insertion of said individual negatives, wherein said means for opening said envelopes comprises:

a track for supporting a plurality of continuous feed storage envelopes;

a first suction assembly having a stationary operating position operative to direct a flow of air away from said first face of one envelope at a time causing a vacuum to secure said envelope with respect to said track; and a second independent suction assembly having a stationary operating position operative to direct a flow of air away from said second face of said envelope causing a vacuum to open said envelope.

2. The invention of claim 1, wherein said second suction assembly is pivotally mounted, for motion between a first loading position exposing said track for loading said continuous feed storage envelopes onto said track, and a second stationary operating position wherein the inlet of said second suction means is in proximity to said second face of one said envelope causing said envelope to open.

3. The invention claim 1, wherein said first and said second suction means each comprise a housing with intake vent openings on a first side of said housing for intake of air, outlet vent openings on a second side for discharge of air, a fan mounted inside said housing which, upon operation of said fan, a flow of air is generated in said intake vent openings and out said outlet vent openings providing suction at said intake vent openings.

4. The invention claim 1, wherein said device further comprises means for mechanically printing on said continuous feed storage envelopes for identification of individual negatives.

5. A device for cutting photographic film into individual negatives and placing said negatives into envelopes, having a holder for dispensing said photographic film, cutting means for severing said photographic film into individual negatives, means for transferring said photographic film to said cutting means, and means for transferring said individual negatives to said envelopes, wherein said means for transferring said individual negatives comprises:

at least one air permeable conveyor track, having top and bottom sides; and means for providing suction through said permeable conveyor track whereby said individual negatives are held to said top side of said permeable conveyor track ensuring reliable transportation into said envelopes.

6. The invention of claim 5, wherein said means for transferring said negatives further comprises means for directing a burst of air to further convey said negative from said permeable conveyor track to said envelope.

7. The invention of claim 5, wherein said cutting means for severing said photographic film further comprises a mechanically moveable cursor, said cursor being manually positionable by a handwheel, said cursor being configured to identify the next cut of said photographic film corresponding to the amount of film advanced prior to cutting.

8. The invention of claim 5, wherein said permeable conveyor or track comprises a plurality of flexible bands.

9. A device for cutting photographic film into individual negatives and placing said negatives into individual continuous feed envelopes, each of said envelopes having a first face base side and a second face opening side, said device having cutting means for severing said photographic film into individual negatives, wherein the improvement comprises:

means for opening said envelopes, comprising a track for movably holding said envelopes, a first suction means directed onto said first face of one envelope to secure said envelopes to said track, and a second suction means having a stationary operative position disposed opposite said first suction means and directed onto said second face of one said envelope causing said envelope to open; and means for transferring said individual negatives comprising at least one permeable conveyor track, having top and bottom sides, and means for providing suction through said bottom side of said permeable conveyor track whereby said individual negative is held to said top side of said permeable conveyor track to ensure reliable transportation into said envelopes.

10. The invention of claim 9, wherein said second suction means is pivotally mounted, having a loading position exposing said track for loading said continuous feed storage envelopes, and a stationary operating position whereby said second suction means operates on said second face of one said envelope causing said envelope to open.

11. The invention of claim 9, wherein said means for transferring said negatives further comprises means for directing a burst of air to further convey said negative from said permeable conveyor track to said envelope.

12. The invention of claim 9, wherein said means for predeterminatively cutting said photographic film further comprises a mechanically moveable cursor, said cursor being manually positionable by a handwheel, said cursor being configured to identify the next cut of said photographic film corresponding to the amount of film advanced prior to cutting.

13. The invention claim 9, wherein said device further comprises means for mechanically printing on said continuous feed storage envelopes for identification of individual negatives.

14. A device for cutting photographic film into individual negatives and placing said individual negatives into individual continuous feed supply envelopes, comprising:

a holder for said photographic film;

a dispenser for feeding said photographic film from said holder;

a cutter blade;

a film conveyor system having an air permeable conveyor track, a means for providing suction under said track, means for aligning said photographic film relative to said cutter blade, and means for inserting said individual negative into said individual continuous feed storage envelopes;

a pair of envelope opening suction assemblies, a first assembly of said pair being positioned to secure one of a plurality of said individual continuous feed storage envelope, a second assembly of said pair being stationarily positioned to open said one of said individual continuous feed storage envelope;

an envelope track to convey said continuous feed storage envelopes between said pair of envelope opening suction assemblies;

print means located to print on said continuous feed storage envelopes; and control means for activating and controlling said cutter blade, film conveyor system, pair of envelope opening suction assemblies, envelope track and print means.

15. The invention of claim 14, wherein said control means includes a computer integrated into the device, and operative to control said cutter blade, film conveyor system, pair of envelope opening suction assemblies, envelope track and print means according to predetermined operational parameters.

16. The invention of claim 14, wherein said control means includes a computer integrated into the device, and operative to control said cutter blade, film conveyor system, pair of envelope opening suction assemblies, envelope track and print means based on input commands by an operator of said computer control means.

17. A process for cutting and storing photographic film, comprising:

feeding the film along a stepper motor driven track to an established position for cutting;

positioning a cutter blade relative to said film for precision cutting;

cutting said film with said blade;

retaining the cut portion of said film on a conveyor by suction applied through said conveyor;

transporting the cut portion of said film on said conveyor;

positioning a first continuous feed storage envelope to receive the cut portion of said film;

holding a first side of said first envelope through the application of suction on a substantial portion of said first side;

opening said first envelope by directing suction over a substantial portion of a second side of said envelope causing said second side to move consistent with said suction; and inserting said cut portion of said film in said envelope utilizing a short burst of air to propel said cut portion from said conveyor system into said envelope.

18. The method of claim 17, further characterized by the step of printing identification information about said cut portion on said first envelope.

* * * * *